US006012286A

United States Patent [19]

Cantu

[11] Patent Number: 6,012,286

[45] Date of Patent: Jan. 11, 2000

[54] HIGH HEAT PRODUCING SYSTEM

[76] Inventor: Valeriano Cantu, 2446 Barrataria Blvd., Marrero, La. 70072

[21] Appl. No.: 09/050,835

[22] Filed: Mar. 30, 1998

[51] Int. Cl.[7] ..... F01K 3/00

[52] U.S. Cl. ..... 60/509; 60/513; 60/515

[58] Field of Search ..... 60/508, 509, 512, 60/513, 515

[56] References Cited

U.S. PATENT DOCUMENTS

| | | | |
|---|---|---|---|
| 1,804,694 | 5/1931 | Jones . | |
| 3,194,010 | 7/1965 | Lejon | 60/513 X |
| 3,447,314 | 6/1969 | Majkrzak . | |
| 3,516,249 | 6/1970 | Paxton . | |
| 3,739,573 | 6/1973 | Giner | 60/509 |
| 3,972,195 | 8/1976 | Hays et al. . | |
| 4,170,116 | 10/1979 | Williams . | |
| 4,291,232 | 9/1981 | Cardone et al. . | |
| 4,385,494 | 5/1983 | Golben | 60/513 X |
| 5,182,913 | 2/1993 | Robar et al. . | |
| 5,336,059 | 8/1994 | Rowley . | |
| 5,373,698 | 12/1994 | Taylor . | |

*Primary Examiner*—Hoang Nguyen
*Attorney, Agent, or Firm*—C. Emmett Pugh; Pugh/Associates

[57] ABSTRACT

A high heat producing system which transforms a alternating current or a pulsating direct current having a relatively low voltage such as one hundred and ten (110v) volts to a very high electric volt arc wherein the very high electric volt arc has a base temperature of, preferably, at least two thousand (2,000° F.) degrees Fahrenheit. A very high electric volt arc is created and encapsulated in a chamber and is propagated through a fuel medium within such chamber to a rotating arc mobilizer. The heat energy of the very high electric volt arc increases the temperature of the fuel medium to further increase the temperature of the high heat producing system. In the preferred embodiment, the high heat producing system is in direct heat transfer with a working fluid in an expansion chamber for powering a turbine or the like.

20 Claims, 5 Drawing Sheets

HIGH HEAT PRODUCING SYSTEM

TECHNICAL FIELD

The present invention relates to fire producing devices, and more particularly to a high heat producing system which transforms a alternating current or a pulsating direct current having a relatively low voltage such as 110 Volts to a very high electric volt arc wherein the very high electric volt arc has a base temperature of, preferably, at least about two thousand (2,000° F.) degrees Fahrenheit. The very high electric volt arc is created and encapsulated in a chamber and is propagated through a fuel medium within such chamber to a rotating arc mobilizer. The heat energy of the very high electric volt arc increases the temperature of the fuel medium to further increase the temperature of the high heat producing device. In the preferred embodiment, the high heat producing device is in direct heat transfer with a working fluid in an expansion chamber for powering a turbine or the like.

BACKGROUND ART

Systems which convert heat energy to mechanical or electrical sources of power are known. For example, some turbine engines utilize a source of heat such as from an expansion chamber to heat a working fluid having expansion properties when heated. The working fluid is vaporized and expanded via heat energy to power turbines.

There are numerous sources of heat, one of which is as simple as a flame. The biggest challenge in creating heat energy is the source of fuel which undergoes combustion to produce the necessary temperature. Such source of fuel becomes depleted over time as the combustion thereof takes place. Therefore, a reservoir for storing therein significant amounts of fuel to maintain the engine powered must be provided. Furthermore, such reservoir occupy space and must be refilled from time-to-time. Other sources of heat include chemical reactions. A drawback with typical sources of heat energy is the limitation of the maximum achievable base temperature created by the combustion of fuel or the chemical reaction. However, in some applications, it is desirable to heat a working fuel to a very high temperature. Another drawback with known sources of heat energy is that the exhaust from the combustion of fuel or a chemical reaction are expelled into the environment.

A listing of prior patents, which may be relevant to the invention, is presented below:

| Patent No. | Patentee(s) | Issue Date |
|---|---|---|
| 1,804,694 | Jones | May 12, 1931 |
| 3,447,314 | Majkrzak | June 3, 1969 |
| 3,516,249 | Paxton | June 23, 1970 |
| 3,972,195 | Hays et al. | August 3, 1976 |
| 4,170,116 | Williams | October 9, 1979 |
| 4,291,232 | Cardone et al. | September 22, 1981 |
| 5,182,913 | Robar et al. | February 2, 1993 |
| 5,336,059 | Rowley | August 9, 1994 |
| 5,373,698 | Taylor | December 20, 1994 |

The Jones patent (U.S. Pat. No. 1,804,694) discloses a mercury vapor turbine in which the mercury is vaporized by a flame which vaporized mercury is used to drive a turbine for powering automobiles and airplanes.

The Majkrzak (U.S. Pat. No. 3,447,314) is directed to a mercury-vapor turbo-generator used, for example to provide electrical power at a remote location. In the turbo-generator mercury in liquid form is initially heated and then superheated by combustion exhaust gases.

The Paxton (U.S. Pat. No. 3,516,249) patent discloses a mercury turbine which uses a mercury boiler and mercury pump in which the mercury components are used to heat water to run a steam turbine.

The Hays et al. (U.S. Pat. No. 3,972,195) patent discloses an inert gas turbine engine. The invention by Hays et al. teaches the use of a combustion chamber which includes a fuel manifold connected to a fuel nozzle and an ignitor which initiates combustion within the combustion chamber. The fuel nozzle is located at the entry of the combustion chamber such that fuel can be mixed with compressed air as the air enters the combustion chamber and flows rearwardly. The ignitor then ignites the fuel and air mixture within the combustion chamber. The combusted gases within the combustion chamber will heat the expansion chamber which is in heat transfer relationship with the combustion chamber. The working fluid within the expansion chamber will then be vaporized. The increase in pressure due to the working fluid expansion will force the vaporized fluid through the turbine nozzles thereby rotating turbine wheels.

The Williams (U.S. Pat. No. 4,170,116) patent discloses a number of possible working fluids for his thermal energy to mechanical conversion system, including, for high temperature applications, mercury.

The Cardone et al. (U.S. Pat. No. 4,291,232) patent discloses the use of ammonia dissolved in water and when ammonia is dissolved in water, a great deal of heat is given off as the heat of solution, about eight and four-tenths (8.4) kilo-calories per mole, using pure reactants. The Cardone et al. patent further discloses other solvents which can be used with water.

The Robar et al. (U.S. Pat. No. 5,182,913) patent discloses an engine system which uses a refrigerant fluid. The system utilizes the heat from the combustion of propane fuel by means of a burner element. Robar et al. also discloses that other fuels such as natural gas, gasoline, oil or other hydrocarbon fuels may be substituted.

The Rowley (U.S. Pat. No. 5,336,059) patent discloses a rotary heat driven engine. The liquid refrigerant is in a boiler or power evaporator and is heated to a vapor creating pressure.

The Taylor (U.S. Pat. No. 5,373,698) patent discloses a inert gas turbine engine which heats a working fluid within an expansion chamber. The working fluid within the expansion chamber is heated by the combustion of compressed air and fuel within the combustion chamber. The heated working fluid within the expansion chamber rotates an expansion turbine which in turn rotates a compressor.

While each of the sources of heat energy described above function as desired, none of the disclose a high heat producing device which transforms a alternating current or a pulsating direct current having a relatively low voltage such as a hundred and ten (110v) volts to a very high electric volt arc wherein the very high electric volt arc has a base temperature of, preferably, at least about two thousand (2,000° F.) degrees Fahrenheit; wherein the very high electric volt arc is created and encapsulated in a chamber and is propagated through a fuel medium within such chamber to a rotating arc mobilizer; and wherein the heat energy of the very high electric volt arc increases the temperature of the fuel medium to further increase the temperature of the high heat producing device.

As will be seen more fully below, the present invention is substantially different in structure, methodology and approach from that of the prior fire producing devices.

GENERAL DISCUSSION OF INVENTION

The preferred embodiment of the high heat producing device of the present invention solves the aforementioned problems in a straight forward and simple manner. What is provided is a high heat producing system which transforms a alternating current or a pulsating direct current having a relatively low voltage such as one hundred and ten (110v) volts to a very high electric volt arc wherein the very high electric volt arc has a base temperature of, preferably, at least about two thousand (2,000° F.) degrees Fahrenheit. The very high electric volt arc is created and encapsulated in a chamber and is propagated through a fuel medium within such chamber to a rotating arc mobilizer. The heat energy of the very high electric volt arc increases the temperature of the fuel medium to further increase the temperature of the high heat producing device. In the preferred embodiment, the high heat producing device is in direct heat transfer with a working fluid medium in an expansion chamber for powering a turbine or the like.

The high heat producing device of the present invention comprises: an enclosure having a center axis and has free space wherein said enclosure is defined by a top surface member and a bottom surface member in parallel spaced relation and an outer perimeter surface coupled to the outer perimeter edge of said top and bottom surface members and said free space has filled therein a medium and wherein said enclosure radiates heat energy therefrom; an electrically continuous conductive member coupled to an interior surface of said outer perimeter surface; a rotating arc mobilizer coupled in a center axis of said bottom surface member; and, a step-up transformer which receives a relatively low initial voltage and steps-up said relatively low initial voltage to a high electric voltage wherein said step-up transformer is coupled to said electrically continuous conductive member to deliver said high electric voltage thereto and wherein at least one very high electric volt arc having a base temperature is formed from said electrically continuous conductive member to said rotating arc mobilizer through said medium.

The method of producing high heat of the present invention comprises the following steps:

providing a high heat producing system wherein the high heat producing system comprises an enclosure having a center axis and has free space wherein the enclosure is defined by a top surface member and a bottom surface member in parallel spaced relation and an outer perimeter surface coupled to the outer perimeter edge of the top and bottom surface members and the free space has filled therein a medium and wherein the enclosure radiates heat energy therefrom; an electrically continuous conductive member coupled to an interior surface of the outer perimeter surface; a rotating arc mobilizer coupled in a center axis of the bottom surface member; and a step-up transformer which receives a relatively low initial voltage and steps-up the relatively low initial voltage to a high electric voltage wherein the step-up transformer is coupled to the electrically continuous conductive member to deliver the high electric voltage and wherein at least one very high electric volt arc having a base temperature is formed from the electrically continuous conductive member to the rotating arc mobilizer;

applying the relatively low voltage to the transformer;

transforming the relatively low voltage to the very high electric voltage;

conducting the very high electric voltage through the electrically continuous conductive member;

creating the at least one very high electric volt arc to the rotating arc mobilizer through the medium; and rotating the arc rotating mobilizer.

In view of the above, an object of the present invention is to provide a high heat producing device which couples a relatively low voltage readily available such as from the public utility company and couples the voltage to a transformer to step-up the low voltage to a significantly higher voltage. The significantly higher voltage is coupled to a conductor ring within an arc encapsulation chamber and in close proximity to the conductor ring there is a rotating electrically conductive member (herein after referred to as a "rotating arc mobilizer") which attracts the significantly higher electric voltage to create a very high electric volt arc between such conductor ring and itself. The very high electric volt arc is propagated through a fuel medium, such as, without limitation, mercury, to the rotating arc mobilizer within the arc encapsulation chamber.

In the preferred embodiment, such rotating arc mobilizer includes at least two arc rods to create at least two the very high electric volt arcs and is rotated between eighteen hundred and thirty-six hundred (1,800–3,600 RPMs) revolutions per minute. As can be appreciated, if visually observed, a continuous illuminating heat energy field is created since the very high electric volt arcs follows around the conductor ring to the arc rods of the rotating arc mobilizer as the rotating arc mobilizer is rotated.

Another object of the present invention is to provide a high heat producing device which is capable of producing a very high electric volt arc of any desired base temperature wherein the very high electric arc created is related to the ratio of transformation of the relatively low voltage via a transformer to the significantly higher electric voltage. More specifically, an increase in the number of turns of secondary windings in relation to the primary winding of the transformer increases the significantly higher electric voltage and the higher the significantly higher electric voltage the greater the base temperature of the very high electric volt arc. Therefore, the high heat producing device of the present invention is capable of producing super heat by significantly increasing the ratio between the primary winding and the secondary winding.

A further object of the present invention is to provide a high heat producing device which has application in environments which require very high heat which could not be otherwise achieved by the combustion of fuel or chemical reactions.

It is a still further object of the present invention to provide a high heat producing device which produces heat from the application of electric power to create a very high electric arc having a high base temperature and preferably has a super heat base temperature.

It is a still further object of the present invention to provide a high heat producing device which propagates the very high electric arc within an arc encapsulation chamber having sealed therein a fuel medium which is heated by the transfer of heat from the very high electric arc to the fuel medium. As the fuel medium is heated, agitation of the molecules of the fuel medium creates friction between the molecules. Thereby, the temperature of the fuel medium increases above the base temperature of the very high electric arc.

It is a still further object of the present invention to provide a high heat producing device which serves the function of the combustion chamber of conventional turbine engine systems.

It is a still further object of the present invention to provide a high heat producing device which is receivable within an expansion chamber having filled therein a working fluid medium which has expansion properties when heated wherein the high heat producing device is in direct heat transfer relation with the working fluid medium of the expansion chamber.

In an alternative embodiment of the present invention, the expansion chamber which has a working fluid medium filled therein and has directly coupled therein at least one arc mobilizer for propagating a very high electric volt arc through the working fluid medium. Thereby, the base temperature of the very high electric volt arc directly heats the working fluid medium in the expansion chamber to power a turbine or the like.

In view of the above, it is a feature of the present invention to provide a high heat producing device which eliminates the combustion of fuel wherein the exhaust from such combustion often times is expelled to the environment. The high heat producing device does not produce exhaust fumes or vapors to create a source of high heat energy.

The above and other objects of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein.

DESCRIPTION OF THE PREFERRED EMBODIMENT

Figure 1B:
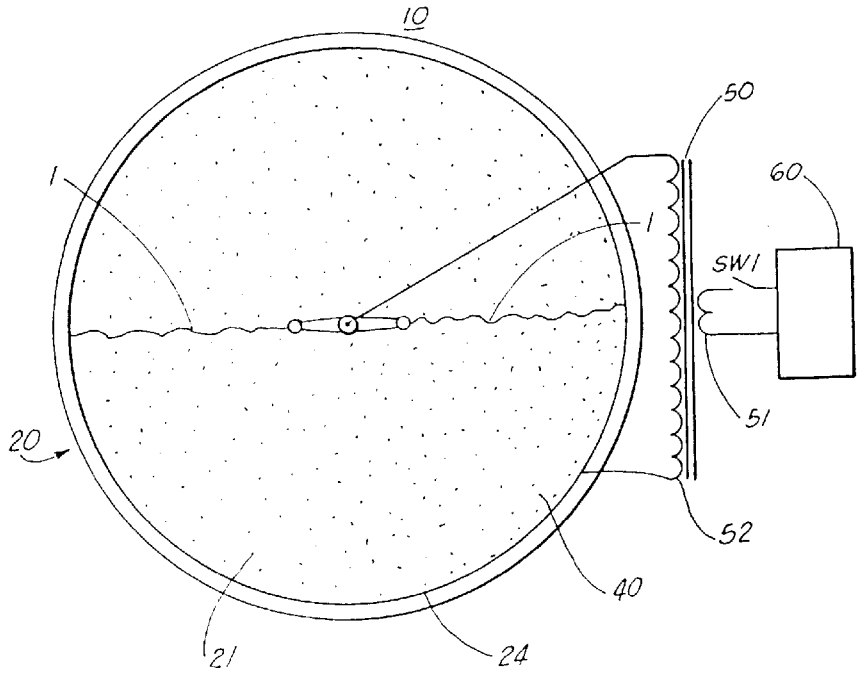
FIG. 1B is a top view of a first, exemplary embodiment of the high heat producing device of the embodiment of FIG. 1A.
Figure 1A:
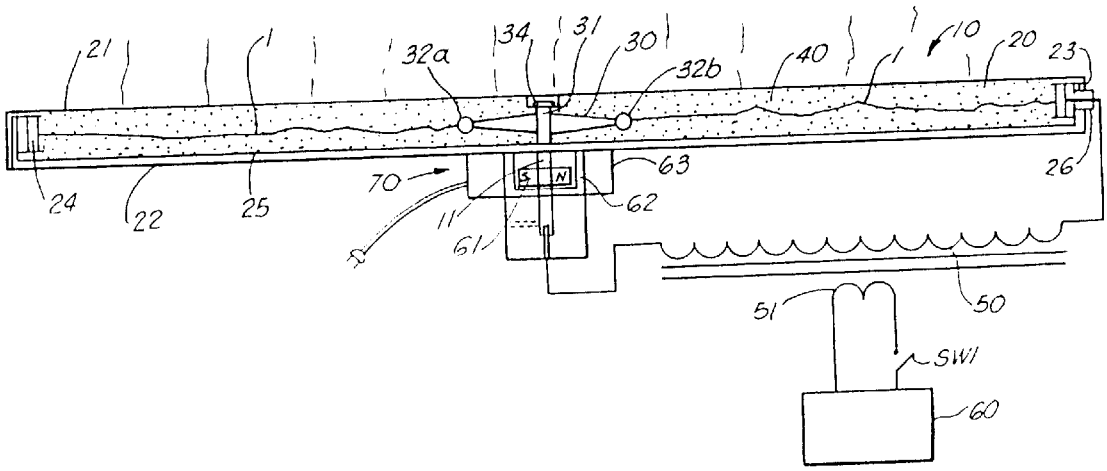
FIG. 1A is a cross-sectional view of a first, exemplary embodiment of the high heat producing device of the present invention.

As can be seen in FIGS. 1A and 1B, the first initial, exemplary embodiment of the high heat producing device of the invention is designated by the reference numeral 10. The high heat producing device 10 comprises an arc encapsulation chamber 20, an rotating arc mobilizer 30, a fuel medium 40, a step-up transformer 50, an electric power source 60, and a rotor means 70.

Figure 2A:
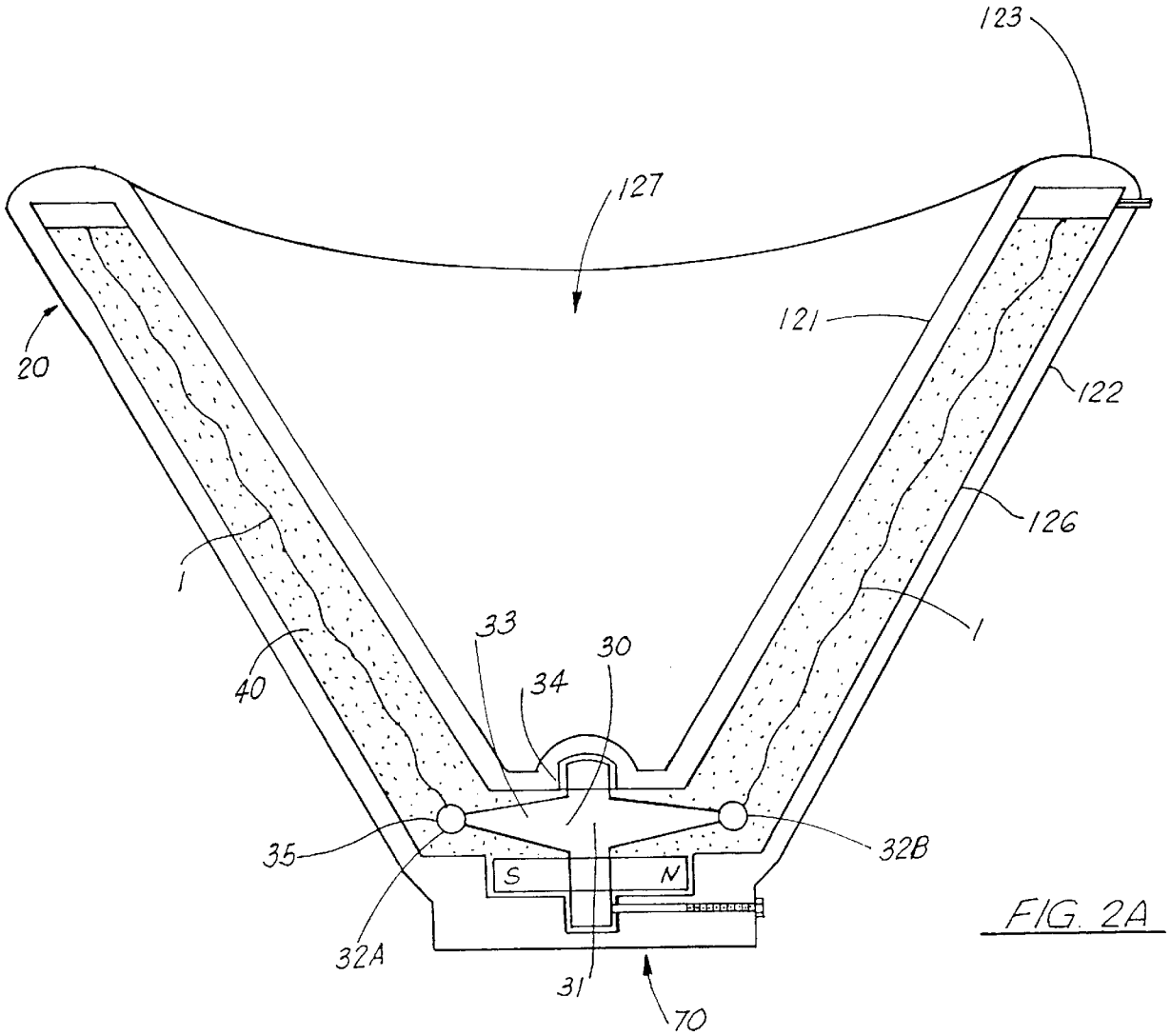
FIG. 2A is a cross-sectional view side view of a second, exemplary embodiment of the present invention.
Figure 2B:
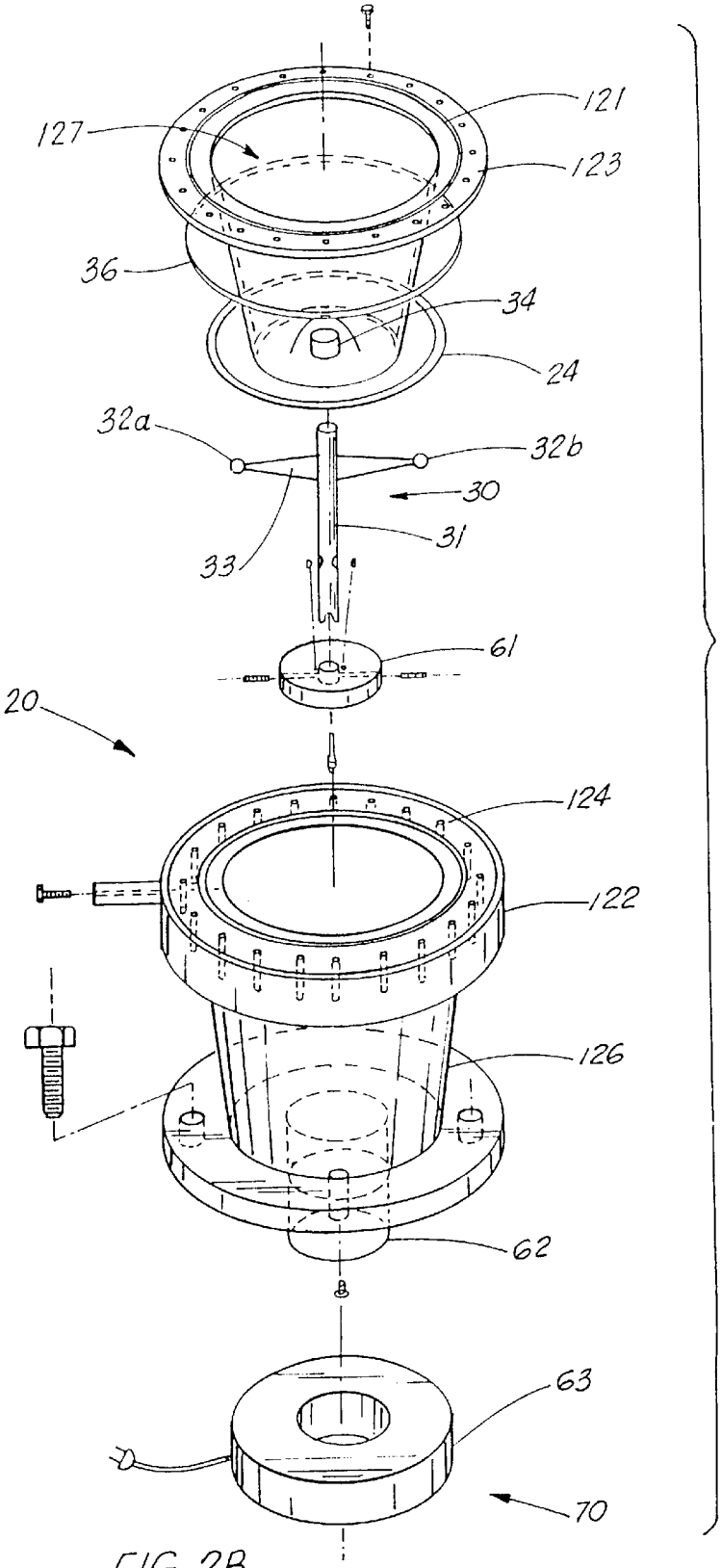
FIG. 2B is an exploded perspective view of a second, exemplary embodiment of the embodiment of FIG. 2A.

The arc encapsulation chamber 20 comprises an enclosure for encapsulating therein the fuel medium 40, the very high voltage electric arcs 1 and the rotating arc mobilizer 30. The enclosure may be disc shaped, as best seen in FIGS. 1A and 1B, cone shaped, as best seen in FIGS. 2A and 2B, or any other shape desired to produce the desired objectives desired herein below. The arc encapsulation chamber 20 of the exemplary embodiment of FIGS. 1A and 1B and the arc encapsulation chamber 20 of the alternative embodiment of FIGS. 2A and 2B differs only in outer perimeter contour of such arc encapsulation chambers.

Figure 3:
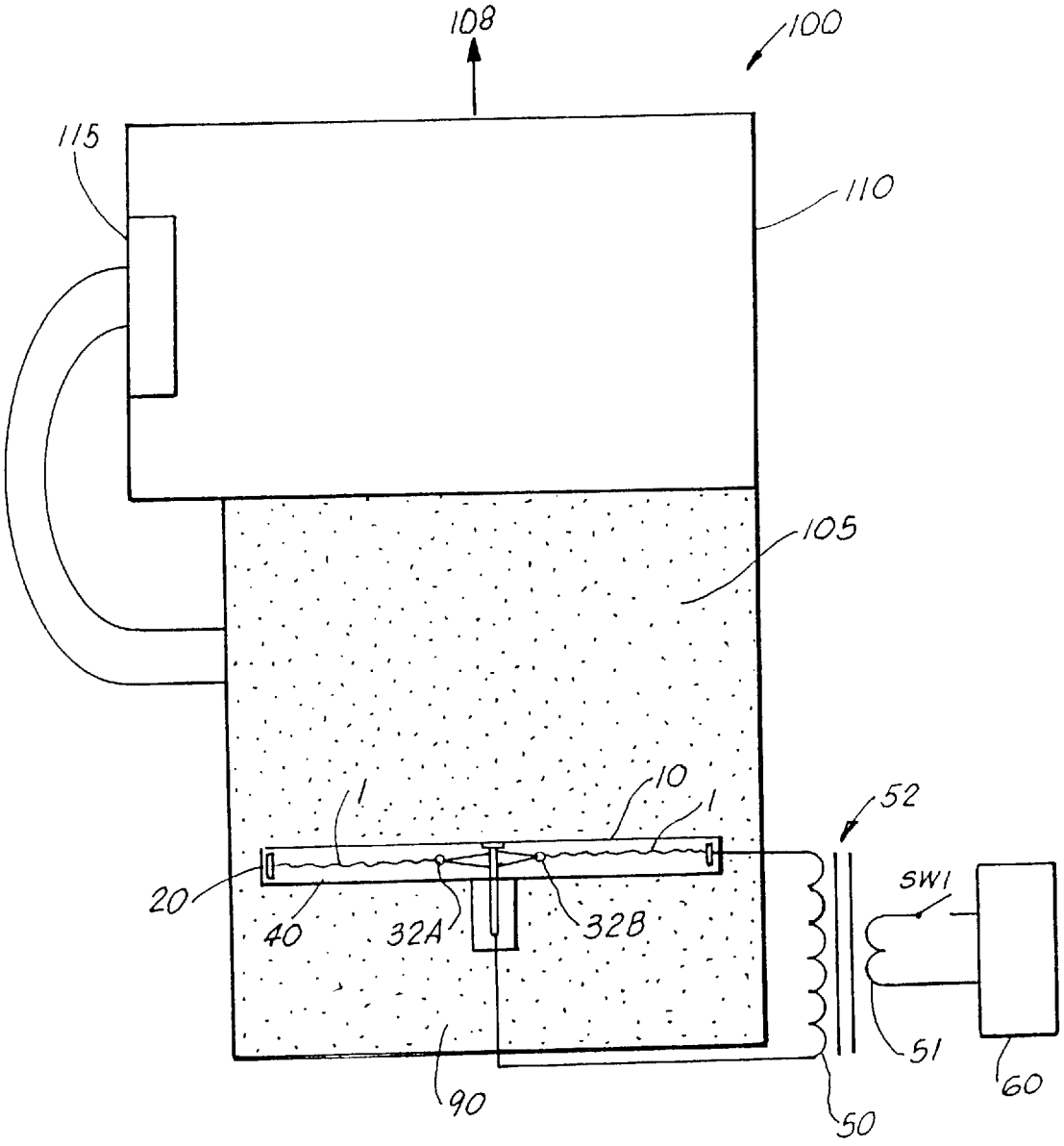
FIG. 3 is a view of a turbine engine system incorporating the high heat producing device of the embodiment of FIG. 1.

In the first embodiment, as shown in FIGS. 1A and 1B, the arc encapsulation chamber 20 is disc shaped. The diameter of the disc-shaped arc encapsulation chamber can be maximized to the dimensions of the expansion chamber 90 of the turbine engine system 100, as best seen in FIG. 3, in which the high heat producing device 10 is placed.

The arc encapsulation chamber 20 comprises a top disc-shaped surface 21, a bottom disc-shaped surface 22 and a circumferentially disposed outer perimeter surface 23 which separates the top disc-shaped surface 21 and the bottom disc-shaped surface 22. The top disc-shaped surface 21 and the bottom disc-shaped surface 22 are in parallel spaced relation with each other and the free space created by the gap therebetween has filled therein fuel medium 40. The interior surface of the circumferentially disposed outer perimeter surface 23 has coupled thereto conductor ring 24, an electrically continuous conductive member.

The bottom disc-shaped surface 22 has coupled in the center axis thereof the rotating arc mobilizer 30. The gap between the top and bottom disc-shaped surfaces 21 and 22 provides the necessary spacing for the unhindered rotation of the rotating arc mobilizer 30. The bottom disc-shaped surface 22 has interiorly coupled thereto a heat reflecting means 25 made of material having heat reflecting properties so that heat will be directed upwardly to the top disc-shaped surface 21. The top and bottom disc-shaped surfaces 21 and 22 and the circumferentially disposed outer perimeter surface 23 create a sealed arc encapsulation chamber 20.

The rotating arc mobilizer 30 comprises shaft member 31 having circumferentially coupled to one end thereof radially at least two arc rods 32*a* and 32*b*.

The top of the shaft member 31 is coupled to top disc-shaped surface 21 via a bushing/bearing coupling 34. In the preferred embodiment, the arc rods 32*a* and 32*b* are spaced one hundred and eighty (180°) degrees with respect to each other to balance the load on shaft member 31. In lieu of two arc rods 32*a* and 32*b*, three or four, etc., arc rods may be circumferentially coupled radially from the shaft member 31 having a one hundred (120°) or ninety (90°) degree, etc., respectively, spacing therebetween.

Each of the arc rods 32*a* and 32*b* comprises an elongated structure 33 terminating into a spherical structure 35. The spherical structure serves as a jumper to which the very high electric volt arcs 1 jump.

The other end of shaft member 31 has coupled thereto the rotor means 70. Rotor means 70 comprises a permanent magnet rotor 61 coupled in a non-magnetic electric insulator member 62, while the non-magnetic electric insulator member 62 is coupled in a donut stator 63. The non-magnetic electric insulator member 62 forms part of the lower housing 22. Donut stator 63 is electrically connected to low voltage, while the lower housing 22 is electrically coupled to one side of the step-up transformer 50.

In the exemplary embodiment, the rotor means 70 is capable of spinning at speed of about eighteen hundred to thirty-six hundred (1,800–3,600 RPMs) revolutions per minute. Nevertheless, rotor means 70 can be operated at any desired speed.

Referring now to FIGS. 2A and 2B, the arc encapsulation chamber 20 is cone shaped. The arc encapsulation chamber 20 comprises a top cone shaped member 121, a bottom cone-shaped member 122 coupled in space relation to create a gap of free space therebetween. The outer perimeter surface 123 at the upper rim of the top cone shaped member 121 and the flared upper rim 124 of the bottom cone-shaped member 122 has interiorly coupled thereto conductor ring 24. The rotating arc mobilizer 30 is coupled in the center axis of arc the bottom cone-shaped member 122.

The interior surface of the bottom cone-shaped member 122 has disposed there along a heat reflector means 126. Thereby, the heat energy is directed upward in the cavity 127 produced the cone shaped contour of the arc encapsulation chamber 20.

The rotating arc mobilizer 30 comprises shaft member 31 having circumferentially coupled to one end thereof radially at least two arc rods 32*a* and 32*b*. The top of the shaft member 31 is coupled to top cone-shaped member 121 via a bushing/bearing 34 coupling. In the preferred embodiment, the arc rods 32*a* and 32*b* are spaced 180 degrees with respect to each other to balance the load on shaft member 31. Each of the arc rods 32*a* and 32*b* comprises an elongated structure 33 terminating into a spherical structure 35. The spherical structure 35 serves as a jumper to which the very high electric volt arcs 1 jump.

The other end of shaft member 31 has coupled thereto the rotor means 70. Rotor means 70 comprises a permanent magnet rotor 61 coupled in a non-magnetic electric insulator member 62, while the non-magnetic electric insulator member 62 is coupled in a donut stator 63. The donut stator 63 is coupled to the one hundred and ten (110v) volt AC power source, requiring extra insulation on the tubular member 62. The lower housing 61 is electrically coupled to one side of the step-up transformer 50.

Referring again to FIGS. 1A and 1B, the step-up transformer 50 has a primary winding 51 and a secondary winding 52, wherein the primary winding 51 has coupled thereto a relatively low voltage such as 110 Volts from power source 60. The secondary winding 52 is coupled via an electric insulator 26 to the conductor ring 24. The second winding 52 steps-up the relatively low voltage to a significantly higher electric voltage and such significantly higher electric voltage electrically conducts through the conductor ring 24.

The path from power source 60 to step-up transformer 50 has coupled therein a means for switching SW1. Therefore, the relatively low voltage can be removed as desired from the step-up transformer 50 by opening the switching means SW1.

The very high electric voltage arcs 1 can produce heat energy having a base temperature of at least about two thousand (2,000° F.) degrees Fahrenheit. In the preferred embodiment, the base temperature produced by such arc does not exceed four thousand (4,000° F.) degree Fahrenheit. Nevertheless, in certain environments, it may be desirable to produce an arc having a base temperature significantly greater than four thousand (4,000° F.) degrees Fahrenheit or significantly lower than two thousand (2,000° F.) degrees Fahrenheit. The voltage potential of the very high electric voltage arcs 1 is of little or no concern except that the arc produces a base temperature adequate to produce the desired heat energy.

In operation, as the relatively low voltage is applied to step-up transformer 50, the transformer 50 steps-up the relatively low voltage to a significantly higher voltage. The significantly high voltage is coupled to the conductor ring 24 and jumps to the spherical structures 35 of the arc rods 32*a* and 32*b* in the center of the conductor ring 24 to create very high electric arcs 1. As the rotating arc mobilizer 30 spins via the mechanical rotor energy of rotor means 70, each arc rod 32*a* and 32*b* attracts the electrical energy from the significantly high voltage conducting in the conductor ring 24. Thereby, the very high electric volt arcs 1 follow the spin path of each arc rod 32*a* and 32*b*, respectively, around the conductor ring 24 to the arc rods 32*a* and 32*b*.

As can be appreciated, if visually observed, a continuous illuminating heat energy field is created since the very high electric volt arcs 1 follow around the conductor ring 24 to the arc rods 32*a* and 32*b* of the rotating arc mobilizer 30 as the rotating arc mobilizer is rotated.

For exemplary purposes, the very high electric volt arcs 1 have a base temperature of at least two thousand (2,000° F.) degrees Fahrenheit are propagated in the fuel medium 40 occupying the free space in the arc encapsulation chamber 20. The heat energy of the very high electric volt arc 1 heat the fuel medium 40. For exemplary purposes, the fuel medium 40 is mercury. Nevertheless, the fuel medium 40 may comprise other gases which can propagate therethrough the very high electric volt arc 1 in the arc encapsulation chamber 20. As the heat energy of the very high electric volt arc 1 is transferred to the fuel medium 40, the molecules of the fuel medium 40 become agitated and the temperature of the fuel medium 40 increases.

As can be readily seen, the high heat producing device 10 is capable of producing a very high electric volt arcs 1 of any desired base temperature wherein the very high electric arcs 1 created are related to the ratio of transformation of the relatively low voltage via the transformer 50 to the significantly higher electric voltage. More specifically, an increase in the number of turns of secondary winding 52 in relation to the primary winding 51 of the transformer 50 increases the significantly higher electric voltage and the higher the significantly higher electric voltage the greater the base temperature of the very high electric volt arcs 1. Therefore, the high heat producing device 10 is capable of producing super heat by significantly increasing the ratio between the primary winding 51 and the secondary winding 52.

Systems which convert heat energy to into mechanical or electrical energy are known. For example, boilers and turbines are well known and utilize thermodynamic properties which have been well established to convert heat energy into mechanical or electrical energy.

Referring now to FIG. 3, an exemplary closed looped turbine engine system 100 is shown. The arc encapsulation chamber 20 is disposed in the expansion chamber 90. Henceforth, the high heat producing device 10 is in direct heat transfer relationship with the working fluid medium 105 of the expansion chamber 90.

The expansion chamber 90 receives therein a working fluid medium 105 such as mercury, water, distilled water, freon or other means of working fluid mediums which when heated has expansion properties. The expansion chamber is in communication with turbine engine 110 or other means capable of converting heat energy to mechanical or electrical energy.

In operation, power is supplied to the arc encapsulation chamber 20 from power source 60 via transformer 50 to produce the very high electric arcs 1. The heat emanating from the very high electric arcs 1 heats the fuel medium 40 sealed in the arc encapsulation chamber 20. The heat energy of the arc encapsulation chamber 20 is transferred directly to the working fluid medium 105 filled in the expansion chamber 90. The heat energy transfer increases the temperature of the working fluid medium 105 injected into the expansion chamber 90 wherein the expansion properties of the working fluid medium 105 when such working fluid medium 105 is heated causes the turbine engine 110 or other means capable of converting heat energy to mechanical or electrical energy to convert the heat energy of the expansion chamber to mechanical or electrical energy at output 108. As the expanded working fluid medium 105 is compressed in compression chamber 115, the compressed working fluid medium 105 is injected into the expansion chamber 90.

Figure 4:
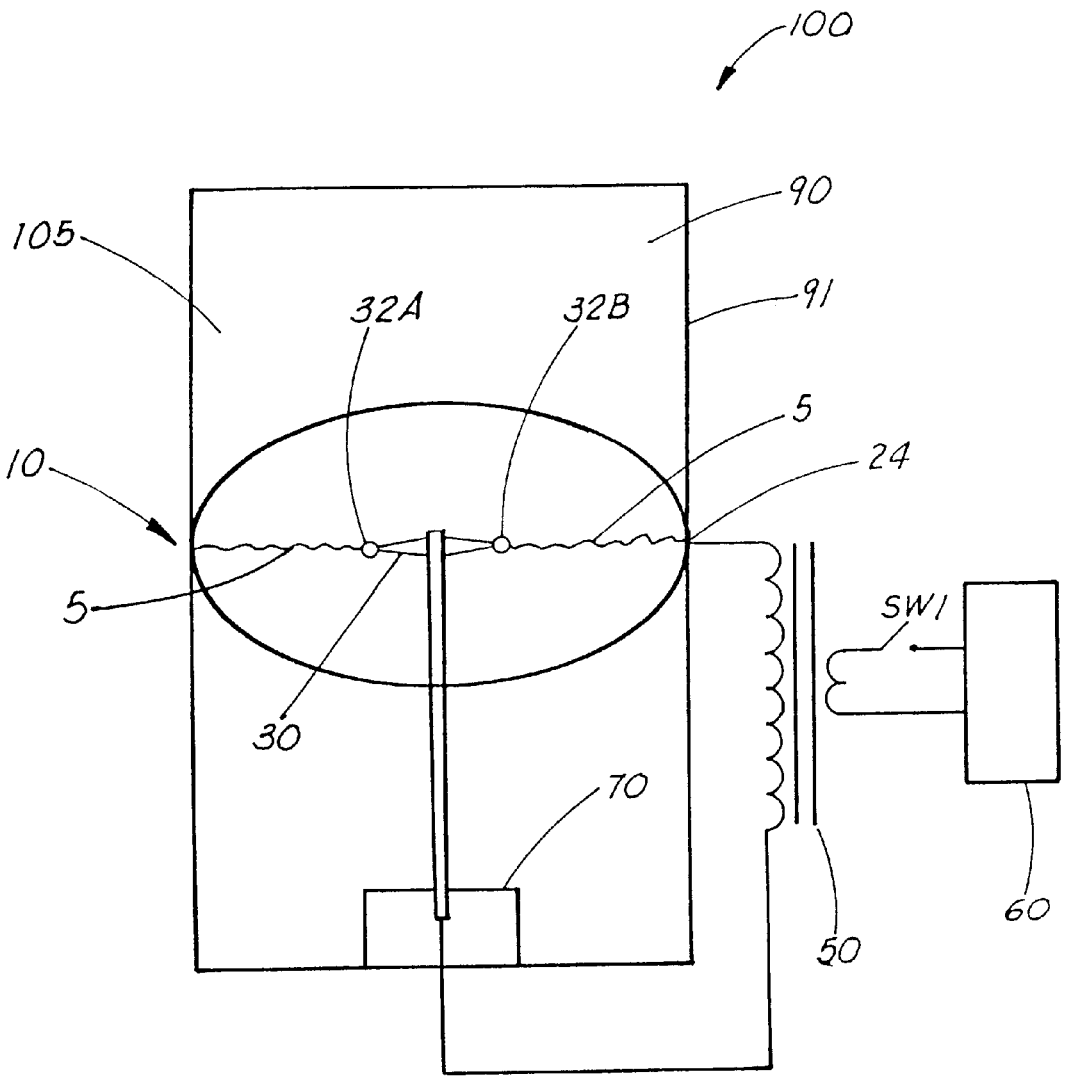
FIG. 4 is a view of a turbine engine system wherein the very high electric arc to the rotating arc mobilizer is propagated within the working fluid medium of the expansion chamber of the turbine engine system.

Referring now to FIG. 4, the high heat producing device 10 comprises at least one rotating arc mobilizers 30, the step-up transformer 50 coupled directly in the expansion chamber 90 of the turbine engine system 100. In general, the high heat producing device 10 eliminates the arc encapsulation chamber and the fuel medium. The very high electric volt arcs 5 are propagated through the working fluid medium 105 in the expansion chamber 90. The at least one rotating arc mobilizers 30 are centrally coupled in the expansion chamber 90 and are rotated via rotary means 70.

The outer perimeter surface 91 of the expansion chamber interiorly coupled thereto conductor rings 24, an electrically continuous member, wherein the at least one rotating arc mobilizer 30 is coupled in the center axis of a respective conductor ring 24.

In operation, as the at least one rotating arc mobilizers 30 is rotated, the very high electric volt arcs 5 are created ed between conductor ring 24 and each individual spherical structure 35 of the arc rods 32*a* and 32*b*. The heat energy of the very high electric volt arcs 5 is in direct heat transfer with the working fluid medium 105 of the expansion chamber 90.

As can be readily seen, the high heat producing devices 10 of the various embodiments of the present invention do not create exhaust from the combustion of fuel or a chemical reaction. More specifically, the heat energy of the very high electric volt arcs created by the embodiments of the present invention do not produce exhausts, fumes or vapors which can harm the environment. The heat energy of the high heat producing devices 10 of the various embodiments merely transforms a relatively low voltage to a significantly high voltage and create at least one very high electric arc therefrom wherein the very high electric volt arc has a base temperature capable of heating a working fluid medium to further derive mechanical or electrical energy. Furthermore, depending on the ratio of the secondary winding to the primary winding of the step-up transformer, the very high electric volt arc is capable of producing super high heat energy.

Of course, the foregoing is merely exemplary of the many different ways the arc encapsulation chamber can be contoured and the high heat producing device of the present invention can be used in connection with heat convertible to mechanical or electrical energy.

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A high heat producing system, comprising:

an enclosure having a center axis and having free space wherein said enclosure is defined by a top surface member and a bottom surface member in parallel spaced relation and an outer perimeter surface coupled to the outer perimeter edge of said top and bottom surface members, and said free space has filled therein a medium and wherein said enclosure radiates heat energy therefrom;

an electrically continuous conductive member coupled to an interior surface of said outer perimeter surface;

a rotating arc mobilizer coupled in a center axis of said bottom surface member; and a step-up transformer which receives a relatively low initial voltage and steps-up said relatively low initial voltage to a high electric voltage, said step-up transformer being coupled to said electrically continuous conductive member to deliver said high electric voltage thereto, said at least one very high electric volt arc having a base temperature formed from said electrically continuous conductive member to said rotating arc mobilizer through said medium.

2. The high heat producing system of claim 1, wherein:

an interior surface of said bottom surface member has coupled thereto a heat reflector member to reflect heat energy from said bottom surface member to said top surface member.

3. The high heat producing system of claim 1, wherein said rotating arc mobilizer comprises:

a shaft member coupled in said center axis of said bottom surface member;

at least two rods radially projecting from said shaft member wherein a very high electric volt arc is formed from said electrically continuous conductive member to each of said at least two rods; and a means for rotating said shaft member.

4. The high heat producing system of claim 3, wherein said rotating means comprises:

a permanent magnet rotor;

a non-magnetic electric insulator member coupled to said permanent magnet rotor; and a donut stator coupled to said non-magnetic electric insulator member.

5. The high heat producing system of claim 1, wherein:

said enclosure is sealed and is disc-shaped and said top and bottom surface members are disc-shaped;

and wherein:

said outer perimeter surface is circumferentially disposed along a outer rim of said top and bottom surfaces, said electrically continuous conductive member being ring shaped.

6. The high heat producing system of claim 1, wherein:

said enclosure is sealed and is cone-shaped, and said top and bottom surface members are cone-shaped, said outer perimeter surface being formed along a top rim of said top and bottom surfaces, said electrically continuous conductive member being ring shaped.

7. The high heat producing system of claim 1, wherein:

said enclosure is an expansion chamber of a turbine engine system and said medium is a working fluid medium having expansion properties when heated.

8. The high heat producing system of claim 1, wherein:

said at least one very high electric volt arc has a base temperature of at least about two thousand (2,000° F.) degrees Fahrenheit.

9. A high heat producing system, comprising:

a chamber having a top surface member and a bottom surface member in parallel spaced relation and an outer perimeter surface coupled to the outer perimeter edge of said top and bottom surface members, wherein said chamber radiates heat energy therefrom; and an electrically continuous conductive member coupled to an interior surface of said outer perimeter surface;

a rotating arc mobilizer coupled in a center axis of said bottom surface member;

a step-up transformer which receives a relatively low initial voltage and steps-up said relatively low initial voltage to a high electric voltage, said step-up transformer being coupled to said electrically conductive member to deliver said high electric voltage, said at least one very high electric volt arc having a base temperature formed from said electrically conductive member to said rotating arc mobilizer; and a medium filling in said chamber wherein said medium propagates therethrough said at least one very high electric volt arc, heat energy being transferred to said medium from said at least one very high electric volt arc to increase a temperature of said medium above said base temperature.

10. The high heat producing system of claim 9, wherein:

an interior surface of said bottom surface member has coupled thereto a heat reflector member to reflect heat energy from said bottom surface member to said top surface member.

11. The high heat producing system of claim 9, wherein said rotating arc mobilizer comprises:

a shaft member coupled in said center axis of said bottom surface member;

at least two rods radially projecting from said shaft member wherein a very high electric volt arc is formed from said electrically continuous conductive member to each of said at least two rods; and a means for rotating said shaft member.

12. The high heat producing system of claim 11, wherein said rotating means comprises:

a permanent magnet rotor;

a non-magnetic electric insulator member coupled to said permanent magnet rotor; and a donut stator coupled to said non-magnetic electric insulator member.

13. The high heat producing system of claim 9, wherein:

said chamber is disc-shaped and said top and bottom surface members are disc-shaped, said outer perimeter surface being circumferentially disposed along a outer rim of said top and bottom surfaces, said electrically continuous conductive member being ring shaped.

14. The high heat producing system of claim 9, wherein:

said chamber is cone-shaped and said top and bottom surface members are cone-shaped and a said outer perimeter surface is coupled to a top rim of said top and bottom surfaces, said electrically continuous conductive member being shaped.

15. The high heat producing system of claim 9, wherein:

said chamber is an expansion chamber and said medium is a working fluid medium having expansion properties when heated.

16. The high heat producing system of claim 9, wherein:

said at least one very high electric volt arc has a base temperature of at least about two thousand (2,000° F.) degrees Fahrenheit.

17. A method of producing high heat, comprising the following steps:

(a) providing a high heat producing system wherein said high heat producing system comprises an enclosure having a center axis and has free space wherein said enclosure is defined by a top surface member and a bottom surface member in parallel spaced relation and an outer perimeter surface coupled to the outer perimeter edge of said top and bottom surface members and said free space has filled therein a medium and wherein said enclosure radiates heat energy therefrom; an electrically continuous conductive member coupled to an interior surface of said outer perimeter surface; a rotating arc mobilizer coupled in a center axis of said bottom surface member; and a step-up transformer which receives a relatively low initial voltage and steps-up said relatively low initial voltage to a high electric voltage wherein said step-up transformer is coupled to said electrically continuous conductive member to deliver said high electric voltage and wherein at least one very high electric volt arc having a base temperature is formed from said electrically continuous conductive member to said rotating arc mobilizer;

(b) applying said relatively low voltage to said transformer;

(c) transforming said relatively low voltage to said very high electric voltage;

(d) conducting said very high electric voltage through said electrically continuous conductive member;

(e) creating said at least one very high electric volt arc to said rotating arc mobilizer through said medium; and (f) rotating said arc rotating mobilizer.

18. The method of claim 17, wherein there is included the step of:

using as the base temperature of said at least one very high electric volt arc a temperature level of at least about two thousand (2,000° F.) degrees Fahrenheit.

19. The method of claim 17, wherein there is included the step(s) of:

using said enclosure as an expansion chamber of a turbine engine system and said medium as a working fluid medium having expansion properties when heated.

20. The high heat producing system of claim 17, wherein said enclosure is sealed, and wherein there is further included the step of:

using said enclosure for direct heat transfer with a working fluid medium of an expansion chamber of a turbine engine system.

* * * * *